United States Patent [19]

Suzuki

[11] 4,385,556

[45] May 31, 1983

[54] MACHINE FOR CUTTING SCRAPPED GOODS

[76] Inventor: Masao Suzuki, 880 Sezaki-cho, Soka-shi, Saitama-Ken, 340, Japan

[21] Appl. No.: 306,149

[22] Filed: Sep. 28, 1981

[51] Int. Cl.[3] ..... B30B 9/32

[52] U.S. Cl. ..... 100/98 R; 83/157; 83/160; 83/373; 83/599; 83/923; 100/218; 100/233; 100/237; 100/295; 100/901

[58] Field of Search ..... 100/901, 218, 98 R, 100/233, 237, 295; 83/923, 157, 150, 373, 160, 599

[56] References Cited

U.S. PATENT DOCUMENTS

| | | | |
|---|---|---|---|
| 3,039,343 | 6/1962 | Richards | 83/923 X |
| 3,367,019 | 2/1968 | Williamson | 100/901 X |
| 3,545,369 | 12/1970 | Tokushima | 100/901 X |
| 3,615,084 | 10/1971 | Wasinger | 83/923 X |
| 4,094,240 | 6/1978 | Suzuki | 100/901 X |

FOREIGN PATENT DOCUMENTS

| | | | |
|---|---|---|---|
| 46-26186 | 7/1971 | Japan | 100/901 |
| 664770 | 5/1979 | U.S.S.R. | 83/923 |

*Primary Examiner*—Billy J. Wilhite

*Attorney, Agent, or Firm*—Arthur T. Fattibene

[57] ABSTRACT

An apparatus for cutting a scrapped good such as a scrapped automobile. The apparatus has a machine frame having a table provided with a recess, and a bifurcated pressing member rotatable into and out of the recess by means of a pressing cylinder. The pressing member has a lifting portion and a cutting portion provided at its both side with cutting edges for co-operation with cutting edges formed at both sides of the recess. As the pressing cylinder is energized, the pressing member is rotated into the recess to cut and press the scrap into tabular form. The pressed tabular scrap is then lifted by the returning rotation of the pressing member to the level of the table surface, and is discharged to the out of the apparatus by means of a pay-off device mounted on the machine frame.

1 Claim, 6 Drawing Figures

MACHINE FOR CUTTING SCRAPPED GOODS

BACKGROUND OF THE INVENTION

The present invention relates to an apparatus for cutting scrap goods such as scrapped automobiles, scrapped structural metallic materials and wooden materials and so forth.

A typical conventional apparatus for cutting scrap goods has a pressing member pivoted at its base end to a machine frame and adapted to be swung and driven into the recess formed in the machine frame thereby to shear the scrapped good placed over the recess by the cutting edges formed at both sides of the pressing member and co-operating cutting edges formed at both sides of the recess. The portion of the scrapped goods pressed into the recess is further compacted by means of a compacting movable along the recess and an anvil portion formed at the end of the pressing member to form a cubic scrap body.

This conventional cutting apparatus has the following problem. Namely, mud and other foreign matters are often involved by the scrap material during the compacting into the cubic form. After the compacting, the foreign matters cannot be found out by a visual check of the cube, to impose some difficulty in the reuse of the scrap material.

SUMMARY OF THE INVENTION

Accordingly, an object of the invention is to provide a cutting apparatus for cutting scrap goods capable of overcoming the above-described problem of the prior art.

To this end, according to the invention, there is provided a cutting apparatus having a bifurcated pressing member having a lifting portion and a cutting portion and wingable into and out of a recess of the machine frame. The tabular scrap portion cut and pressed by the cutting portion into the recess is made to ride the lifting portion of the bifurcated pressing member and is lifted to the level of a table on the machine frame by the returning swinging motion of the pressing member. This scrap is discharged to the outside of the machine frame by means of a pay-off device to avoid the undesirable involvement of the foreign matters in the scrap goods.

The above and other objects, as well as advantageous features of the invention will become clear from the following description of the preferred embodiments taken in conjunction with the accompanying drawings.

BRIEF DESCRIPTION OF THE DRAWINGS

The attached drawings shown an embodiment of the invention in which.

DESCRIPTION OF THE PREFERRED EMBODIMENT

Figure 1:
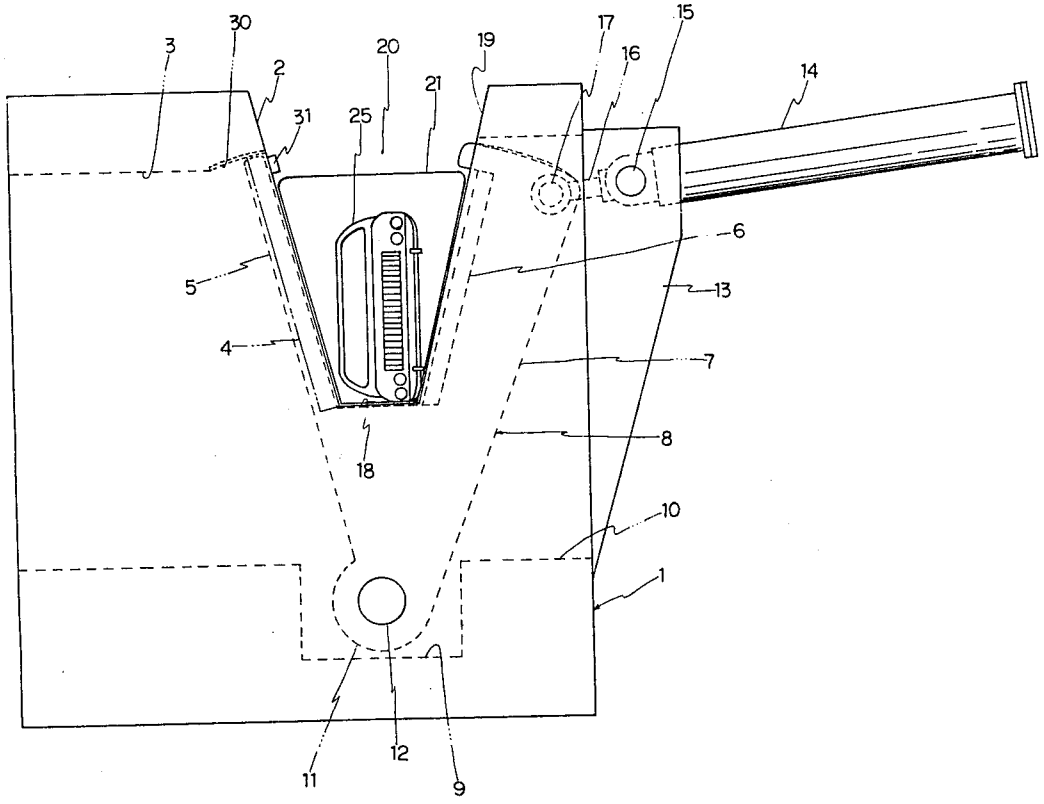
FIGS. 1 to 3 are side elevational views of a cutting apparatus embodying the invention in a different steps of cutting operation.
Figure 5:
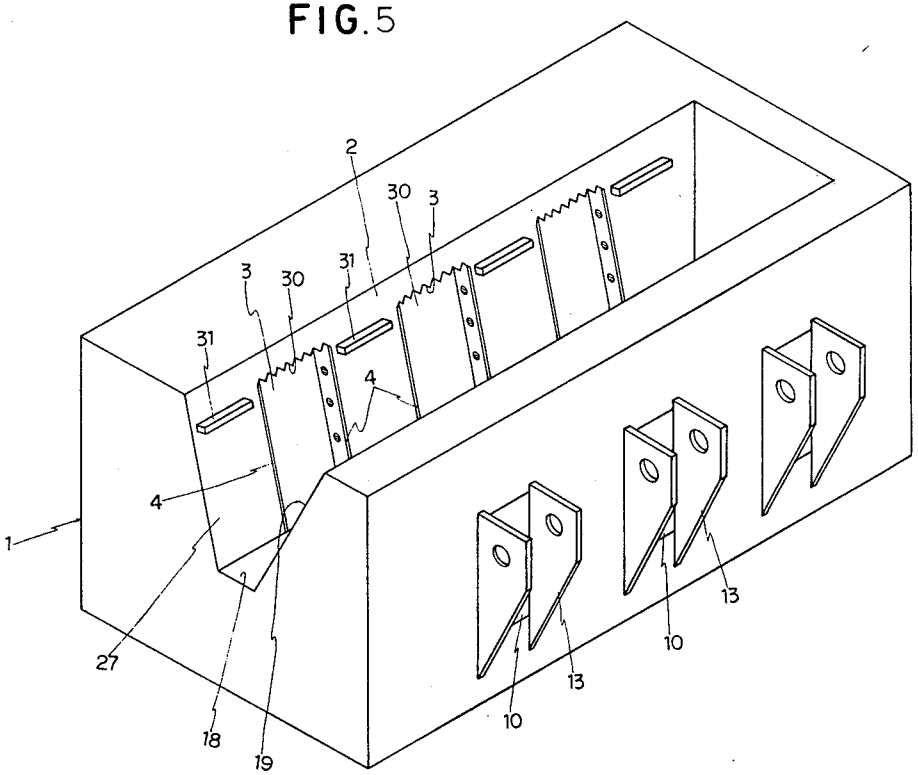
FIG. 5 is a perspective view of a machine frame.

Referring to the drawings, a cutting apparatus in accordance with an embodiment of the invention has a machine frame 1 provided with a table 2 in which is formed at least one recess 3 defined by cutting edges 4,4 formed at both side edges thereof, as will be seen from FIG. 1 showing the side elevation and FIG. 5 showing the machine frame in a perspective view.

Figure 6:
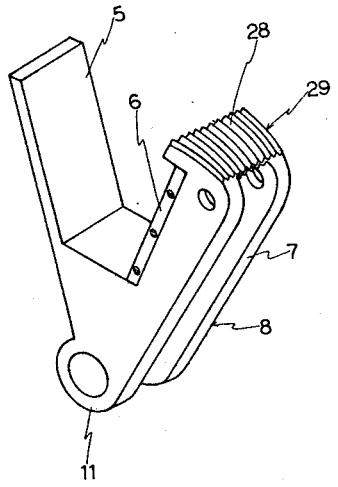
FIG. 6 is a perspective view of a pressing member.

As will be understood from FIG. 6 showing the apparatus in a perspective view, a bifurcated pressing member 8 has a tubular lifting portion 5 and a cutting portion 7 provided at its both sides with cutting edges 6,6. Also, the machine frame 1 is provided with grooves 9 and 10 communicating with the above-mentioned recesses 3. The pressing member 8 is pivoted at its base end 11 received by the groove 9 by means of a pivot shaft 12, such that the lifting portion 5 and the cutting portion 7 are driven into and out of the recess 3.

A pressing cylinger 14 is pivotally connected at its base end by means of a pin 15 to a bracket 13 on the machine frame 1. The pressing cylinder 14 has a pressing piston 16 received by the groove 10 and pivotally connected by a pin 17 to the portion of the cutting portion 7 near the end of the latter.

A pay-off device 24 has a pay-off member 21 adapted to be moved by the extending and retracting motion of the pay-off piston 23 of a pay-off cylinder 22 along a supply port 20 defined by the table 2 and bottom and side guide surfaces 18, 19, in the longitudinal direction of the machine frame 1.

Figure 2:
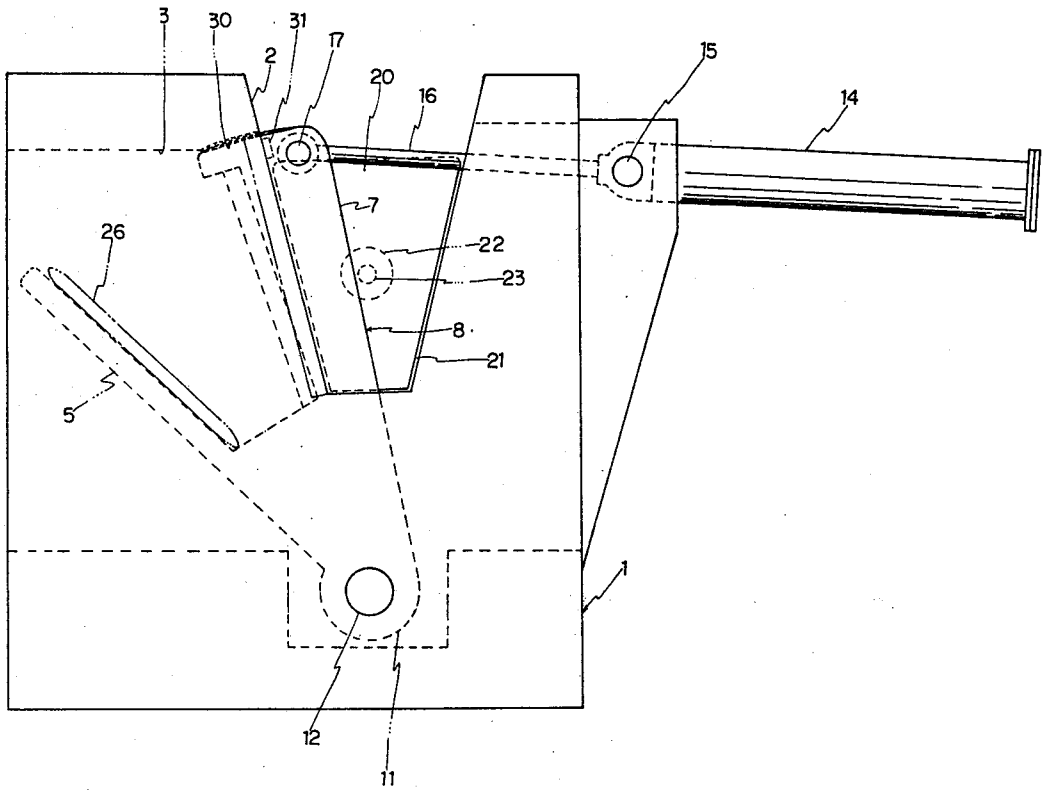
Figure 3:
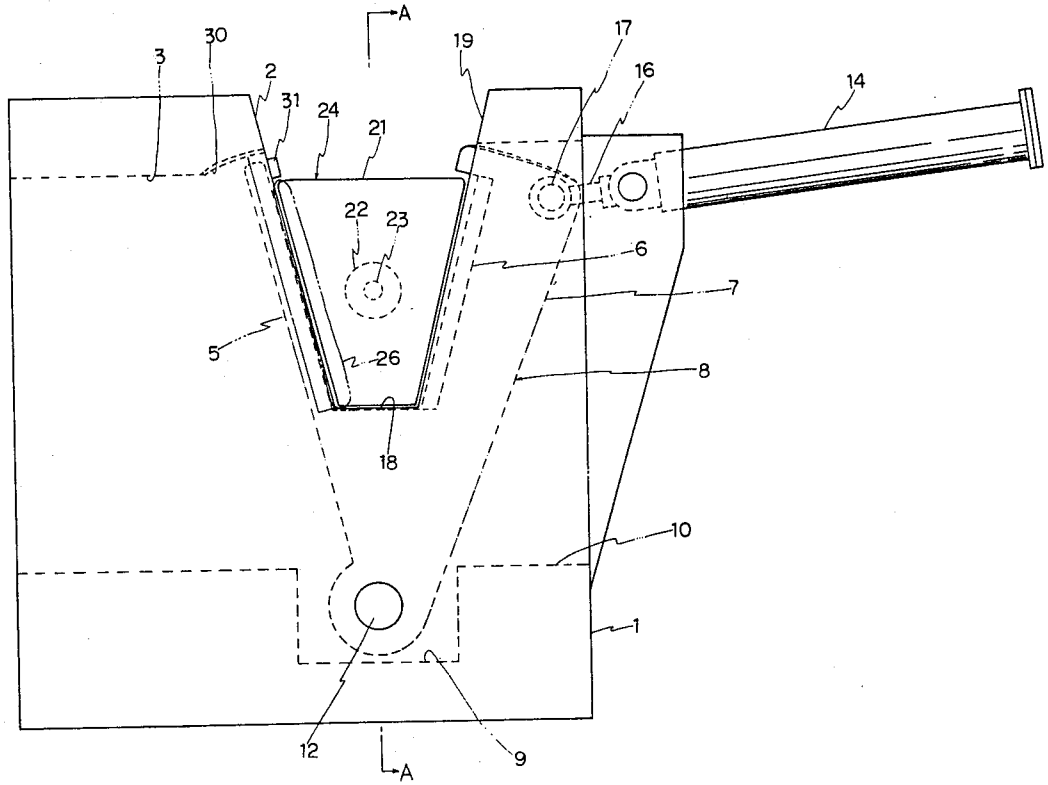
Figure 4:
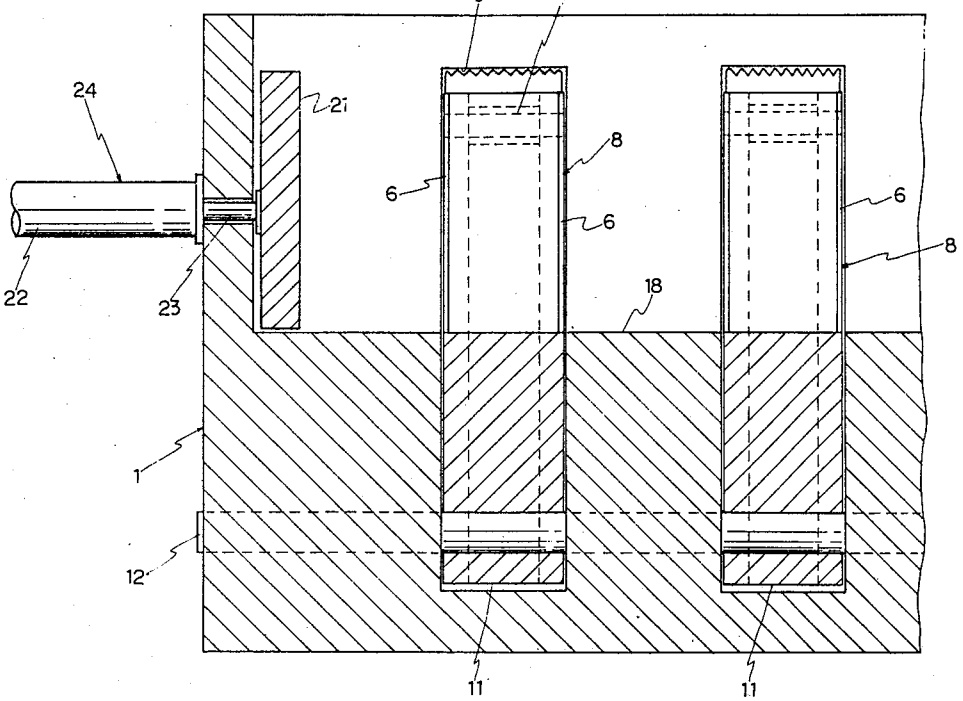
FIG. 4 is a sectional view taken along the line A—A of FIG. 3.

In operation, while positioning the pressing member 8 such that the lifting portion 5 and the cutting portion 7 do not project into the supply port 20, a scrapped good 25 such as a scrapped automobile is put on the bottom guide 18 through the supply port 20, by means of a crane or the like. Then, the pressing piston 16 is extended in the manner shown in FIG. 2 thereby to press and cut the scrapped good 25 by the co-operation of the cutting edges 4,4 of the table 2 and the cutting edges 6,6 of the pressing member 8. In consequence, the scrap 26 pressed into a tabular form is held on the lifting portion 5, so that it is lifted to the level near the table 2 from the recess 3, as the pressing piston 16 is retracted to the position shown in FIG. 3 toward the pressing cylinder 14. In this state, the pay-off piston 23 is extended to press and discharge the scrap 26 to the outside of the machine frame 1 through the supply port 27.

In the illustrated embodiment, a head portion 29 having a comb blade 28 is provided near the rotating end of the cutting portion 7 so as to co-operate with a comb blade 30 formed at the end edge of the groove 3 of the machine frame 1 in cutting the scrapped good. A reference numeral 31 designates an anti slip body adapted to prevent the slipping of the scrapped good 25.

As has been described, according to the invention, there is provided a cutting apparatus having a bifurcated pressing member 8 rotatable into and out of a recess 3 in the machine frame 1 and consisting of a lifting portion 5 and a cutting portion 7. Therefore, by the returning rotational movement of the pressing member 8, the pressed tabular scrap held on the lifting portion 5 is moved to the level of a table 2, and is discharged to the outside of the machine frame 1 by means of the pay-off device 24. In operation, the scrapped good is cut by the cutting edges 4,4 and 6,6 of the pressing member 8 and the recess 3, and is pressed into a tabular scrap by the co-operation between the pressing member 8 and the recess 3. This tabular scrap is lifted immediately to the level of the table by the returning rotation of the pressing member 8, and is discharged in the form of the tabular scrap by means of the pay-off device 24. This tabular pressed scrap has only a little chance of involvement of the mud and other foreign matters so that the quality of the scrap can be very much improved.

The scrapped good on the table 2 is cut and pressed into the tubular scrap and returned to the table by a single reciprocating rotational movement of the pressing member 8, so that the cutting work is very much facilitated and the formed scrap can be taken out of the machine at a high efficiency by means of the pay-off device 24 to permit a continuous scrap-making operation while saving labor.

What is claimed is:

1. An apparatus for cutting scrapped goods comprising: a machine frame having a table provided with at least one recess; a bifurcated pressing member consisting of a lifting portion and a cutting portion and pivoted at its base end to said machine frame in such a manner that said lifting portion and a said cutting portion are rotated simultaneously into and out of said recess, so that a scrapped good placed on said table is cut by the cutting portion of said pressing member and said recess and pressed into a tubular form by the co-operation of said pressing member and said recess as said pressing member is actuated by a pressing cylinder and the pressed tabular scrap is lifted to the level of said table by said lifting portion in the returning rotation of said pressing member caused by the retracting operation of said pressing cylinder; and a pay-off device adapted to discharge said tabular scrap to the outside of said table.

* * * * *